United States Patent [19]

Zahradnik

[11] 4,202,266

[45] May 13, 1980

[54] STAGING MECHANISM FOR DUPLEXING COPY MACHINES

[75] Inventor: George J. Zahradnik, Wheaton, Ill.

[73] Assignee: A. B. Dick Company, Niles, Ill.

[21] Appl. No.: 858,606

[22] Filed: Dec. 7, 1977

[51] Int. Cl.[2] ..... B41F 7/06; B41F 21/04

[52] U.S. Cl. ..... 101/218; 101/230; 101/234; 101/242

[58] Field of Search ..... 101/230, 217, 232, 177, 101/183, 218, 234, 242; 355/23, 24; 271/225, 277, DIG. 9, 69, 194, 195, 82

[56] References Cited

U.S. PATENT DOCUMENTS

| | | | |
|---|---|---|---|
| 214,065 | 4/1879 | Tucker | 270/19 |
| 252,153 | 1/1882 | Stonemetz | 101/230 X |
| 272,834 | 2/1883 | Hawkins | 101/230 |
| 272,835 | 2/1883 | Hawkins | 101/230 |
| 936,151 | 10/1909 | North | 271/277 X |
| 2,412,132 | 12/1946 | Dell | 101/142 X |
| 2,625,101 | 1/1953 | Gammeter | 101/230 |
| 2,723,119 | 11/1955 | Engebretson et al. | 271/225 |
| 3,581,866 | 6/1971 | Hottendorf | 101/230 X |
| 3,648,605 | 3/1972 | Hottendorf | 101/183 X |
| 3,672,765 | 6/1972 | Altmann | 355/24 |
| 3,769,910 | 11/1973 | Heimlicher | 101/177 |

FOREIGN PATENT DOCUMENTS

| | | | |
|---|---|---|---|
| 2633183 | 2/1977 | Fed. Rep. of Germany | 101/230 |
| 1368496 | 9/1974 | United Kingdom | 101/230 X |

OTHER PUBLICATIONS

Xerox Disclosure Journal, "Paper Feeder Concept", vol. 1, No. 3, Mar. 1976.

*Primary Examiner*—J. Reed Fisher

*Attorney, Agent, or Firm*—McDougall, Hersh & Scott

[57] ABSTRACT

A system for providing duplex images on copy sheets wherein the images are formed on the copy sheets by delivering the sheets to an impression cylinder for transfer of the images to the sheets. First and second ink images are provided, and each sheet is fed to the impression cylinder in synchronism with a first image for transfer of the first image to one side of each sheet. Each sheet is then removed to a staging area which includes a conveyor mechanism for re-feeding the sheet to the impression cylinder, trailing edge first. The re-feeding is in synchronism with the movement of the second image whereby this second image is transferred to the opposite side of each sheet. The impression cylinder is provided with a first gripper for engaging the leading edge of each sheet and with a second gripper for engaging the trailing edge of each sheet. The staging area comprises a plurality of conveyor belts and a chamber with air exhaust means beneath the belts. Appropriate perforations are provided whereby evacuation of air from within the chamber and through the perforations holds the sheets in place on the conveyor belts. The belts move in one direction for feeding of the copy sheets into the staging area, and then reverse for re-feeding to the second gripper. Barrier means on the belts accurately align the sheets, and adjustable drive mechanisms accurately deliver the sheets to the impression cylinder.

17 Claims, 16 Drawing Figures

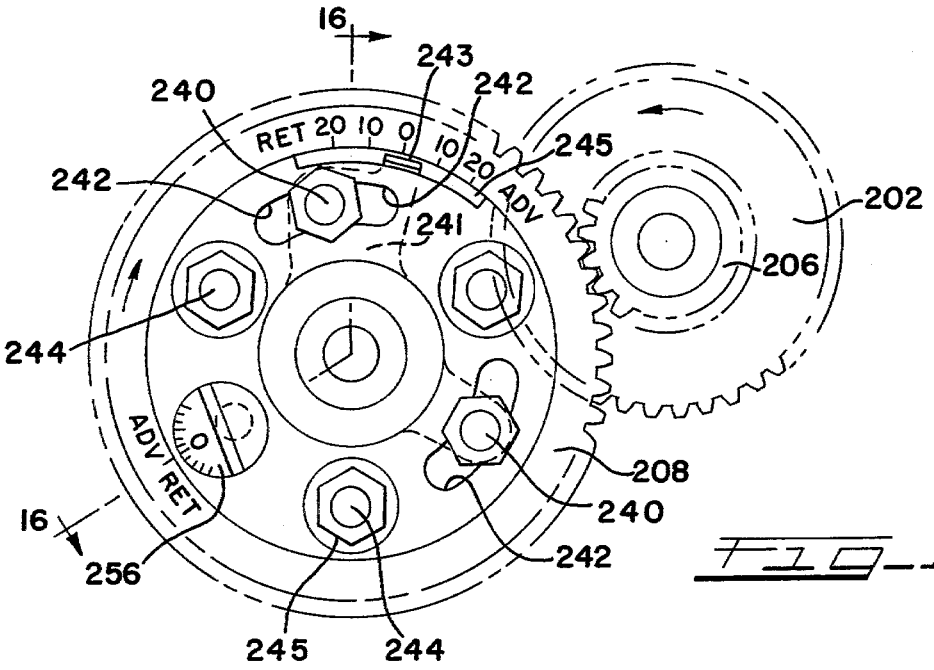
FIG. 15
FIG. 16
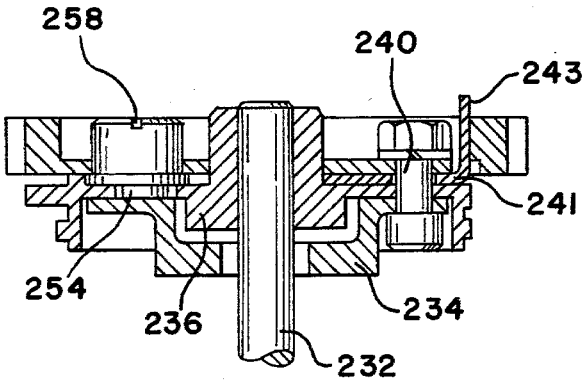

STAGING MECHANISM FOR DUPLEXING COPY MACHINES

BACKGROUND OF THE INVENTION

This invention relates to a system for the production of duplicate copies of images. The invention is particularly concerned with duplicators of the type wherein images are repeatedly formed on an image bearing surface, for example, a blanket cylinder or the like. Copy sheets are introduced to a carrier for the sheets, such as an impression cylinder, for transfer of the images to the copy sheets.

Duplicating equipment is readily available for the production of copies with images formed on one side of the copy sheets, and such equipment can be reliably operated at highly satisfactory production rates. It is recognized, however, that copy sheet material of the type conventionally employed can readily accept images on both sides, and it is highly desirable to provide equipment suitable for transferring images to both sides of a copy sheet. This provides savings in the amount of paper employed and additional savings in the amount of space occupied by the copies produced.

Attempts have been made to produce copy sheets imaged on both sides (hereinafter referred to as "duplexing"). The use of separate presses located in tandem has been proposed, and although this represents a workable system, it is more costly due to the duplication of equipment involved. Paper handling considerations have also resulted in lower press speeds.

Perfector presses have also been employed for duplexing. Such presses utilize double master cylinders, blanket cylinders, ink systems, and dampening systems. More highly skilled operators and equipment expense make such presses undesirable.

Other proposals include the use of a large combination master and impression cylinder associated with a half-size blanket cylinder. In such an arrangement, the master cylinder places a first-side image onto the blanket cylinder whereby images are placed upon the sheets from the blanket cylinder and also from the impression section of the larger cylinder which includes a letter press or direct lithoplate. This system involves a lower production rate than other systems described.

Duplexing of copies may be accomplished by printing a desired number of first side sheets, storing the sheets, and then re-feeding them for receipt of a second side image. Reference is also made to Altmann U.S. Pat. No. 3,672,765 which discloses "on line" duplexing in photoconductive equipment.

Stonemetz U.S. Pat. No. 252,153 teaches a system for duplexing copies wherein a sheet is introduced between an impression cylinder and a type cylinder. In this system, the type cylinder carries two forms for transferring separate images, and a "blank" area is defined between the forms. The type cylinder makes one revolution while the smaller impression cylinder makes three revolutions. The copy sheet is printed on one side during a first revolution of the impression cylinder and discharged from the equipment. The impression cylinder makes an additional revolution while on the "blank" area of the type cylinder passes, and the copy sheet is then re-fed, trailing edge first, for formation of the other image on the other side of the copy sheet during the third revolution of the impression cylinder.

Borneman application Ser. No. 826,847, filed on Aug. 22, 1977, and entitled "Duplexing Copying System" describes a method and means for producing copy sheets printed on both sides. This system utilizes means for directing copy sheets after imaging on one side to a staging or reversing area. At this point the sheets are re-fed, trailing edge first, to an impression cylinder or other copy sheet carrier. The impression cylinder is provided with first and second grippers, with the trailing edges each being engaged by the second gripper of the impression cylinder. The continued movement of the impression cylinder is synchronized with the movement of a second image whereby the second image is formed on the opposite side of each sheet.

SUMMARY OF THE INVENTION

The present invention particularly relates to a highly efficient staging area provided for reversing the direction of sheet movement in a system of the type described in the aforementioned application. The system of that application is particularly adaptable to the duplexing of copy sheets in offset equipment wherein the master cylinders, blanket cylinders and impression cylinders of the equipment are of conventional size. Moreover, the copy sheets to be duplexed are fed to the equipment at high rates of speed so that duplex copies can be obtained at rates comparable to customary rates of production with high quality offset duplicating equipment. It is important, in order to achieve these advantages, that the sheet reversing or staging area is such that the copy sheets are reliably and accurately re-fed to the impression cylinder.

As described in the aforementioned application, separate images may be formed on a blanket cylinder by employing a master cylinder having suitable inking means. The blanket cylinder picks up the ink images from the master cylinder, and drive means rotate these cylinders and an associated impression cylinder in unison while copy sheets are fed between the blanket cylinder and impression cylinder. This invention will be described with reference to offset equipment of this type although the features of the invention have broader application.

In the operation of such systems, feed means introduce one copy sheet for each revolution of the impression cylinder and first gripper means associated with the impression cylinder are adapted to successively engage the leading edge of each sheet. The feeding of each sheet is synchronized with the first image on the blanket cylinder so that one side of each sheet receives the first image. Means are then provided for release of each sheet from the first gripper means, and for movement of each sheet to a sheet reversing or staging area.

A second gripper means is adapted to grip the formerly trailing edge of each sheet as each sheet is re-fed from the staging area. This operation takes place once during each revolution of the impression cylinder. Accordingly, the respective gripping means of the impression cylinder operate to accept separate sheets during each cylinder revolution. The second gripper, by gripping the formerly trailing edge of each sheet, and by moving in synchronism with the second image on the blanket cylinder, provides for transfer of that second image to the opposite side of each sheet. Stripper means operate in conjunction with the impression cylinder so that sheets imaged on one side only can be delivered to the staging area while duplexed sheets are delivered to a receiver area for collection.

As indicated, this invention is particularly related to the staging area for a duplexing system. The staging area consists of means for receiving each copy sheet after the sheets have been imaged on one side. The sheets are directed onto a conveyor mechanism including a plurality of spaced-apart belts. These belts are perforated and they are supported by a chamber which includes evacuating means. Accordingly, as the sheets are moved into contact with the belts, they are held in positive engagement with the belts.

The drive mechanisms in the staging area include reversing means whereby each copy sheet can be re-fed, trailing edge first, to the cylinder. More specifically, the driving action of the belts moves the trailing edges of the copy sheets into registry with the second gripper of the impression cylinder. The impression cylinder then carries each sheet for a second pass between the blanket cylinder and impression cylinder whereby a second image can be formed on the opposite side of each sheet.

DESCRIPTION OF THE DRAWINGS

FIG. 15 is an end view illustrating adjusting means for the shafts; and,

FIG. 16 is a cross-sectional view taken about the line 16—16 of FIG. 15.

DESCRIPTION OF THE PREFERRED EMBODIMENTS

Figure 1:
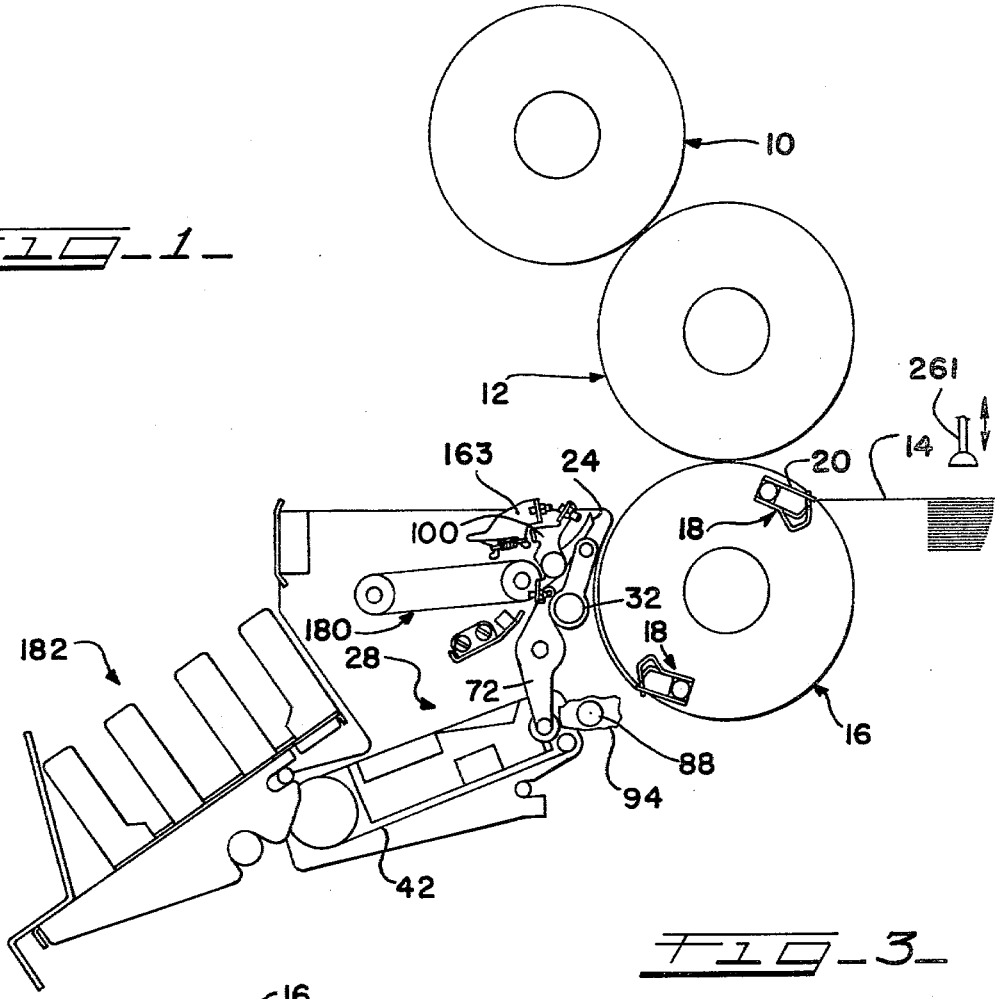
FIG. 1 is a schematic elevational view of offset duplicating equipment characterized by the features of this invention.

The drawings illustrate the apparatus of this invention. In FIG. 1, there is shown an offset duplicating arrangement wherein a master cylinder 10 is employed in association with a blanket cylinder 12. The master cylinder is provided with first and second image plates or sheets or with a single plate or sheet defining first and second image areas. The masters are attached to the master cylinder in conventional fashion, and any suitable ink supply will be utilized in association therewith.

The blanket cylinder 12 is also of conventional design so that ink images will be transferred to the blanket cylinder. It will be apparent that these ink images will be in separate locations on the blanket cylinder. Cylinders of various sizes may be employed, depending upon the size of the copies desired. As explained in the aforementioned application, however, the invention does not require a variation from standard cylinder sizes in order to produce copies of conventional size.

Figure 2:
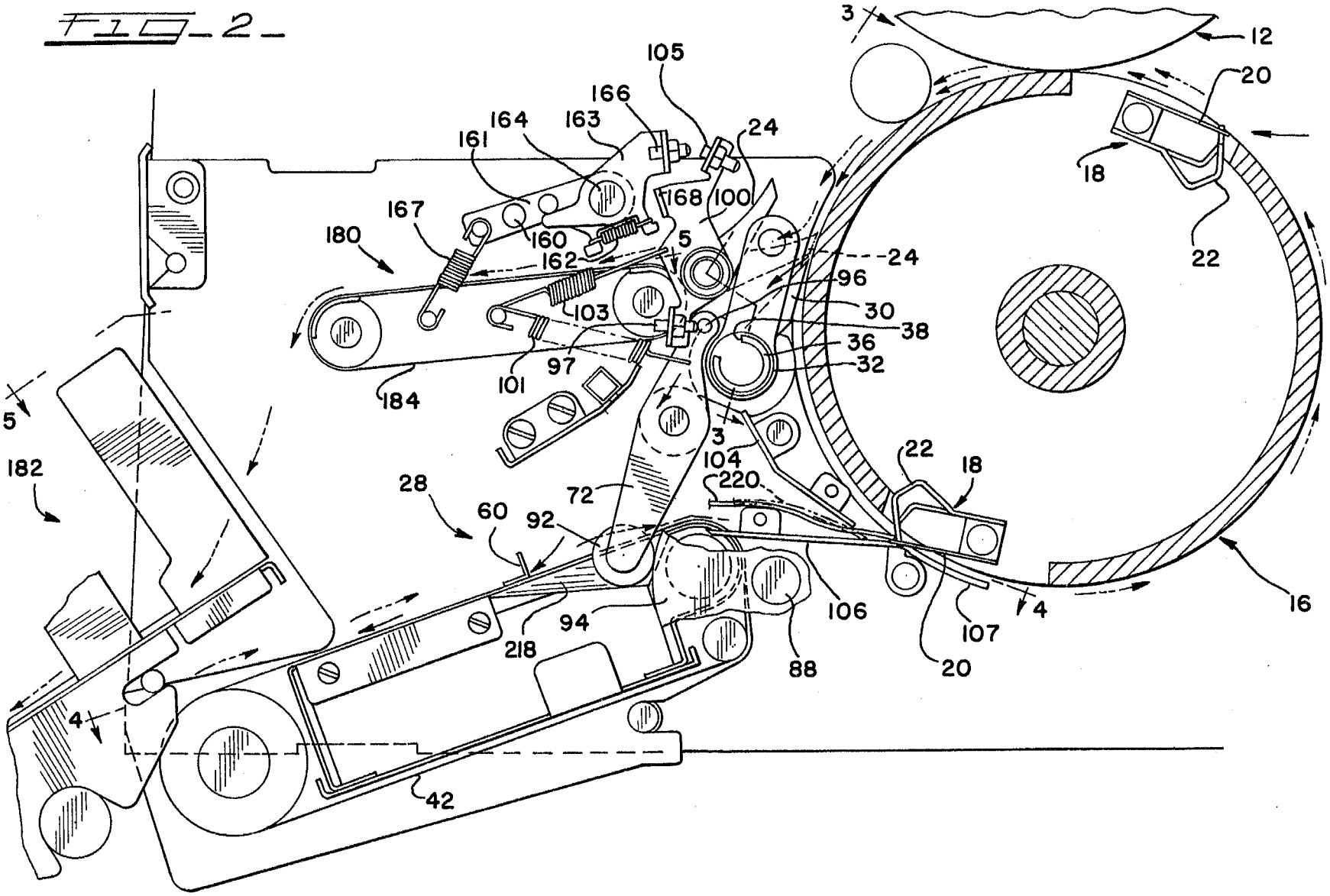
FIG. 2 is an enlarged fragmentary view, partly in section, illustrating the staging area and receiving area of the construction.

The copy sheets 14 are fed one at a time toward impression cylinder 16. In accordance with conventional practice, the impression cylinder grips the leading edge of the copy sheet, and thereby carries the copy sheet between the impression cylinder and blanket cylinder for transfer of ink images to the copy sheet. Suitable gripping means are available to those in the art, for example, paper grippers 18 of the type employed in A. B. Dick offset duplicators, models 350–360. These grippers include pivotally mounted spring fingers 20 adapted to be pressed against copy sheet edges (FIG. 2). Pushing or ejecting means 22 operate to separate the paper edge from the impression cylinder surface after imaging thereby facilitating removal of the sheet from the surface. A more detailed description of the gripper operation can be found in the aforementioned application.

A stripper arrangement is conventionally associated with such offset equipment for purposes of directing copy sheets to a receiving tray. In the embodiment illustrated, a plurality of stripper fingers 24 are mounted on shaft 26, and these fingers would be conventionally located in the solid line position shown in FIG. 6. The shaft 26 is pivotally supported, however, so that the stripper fingers can be pivoted out of a position where they engage with a copy sheet, to thereby permit movement of each sheet to a reversing or staging area 28.

Figure 3:
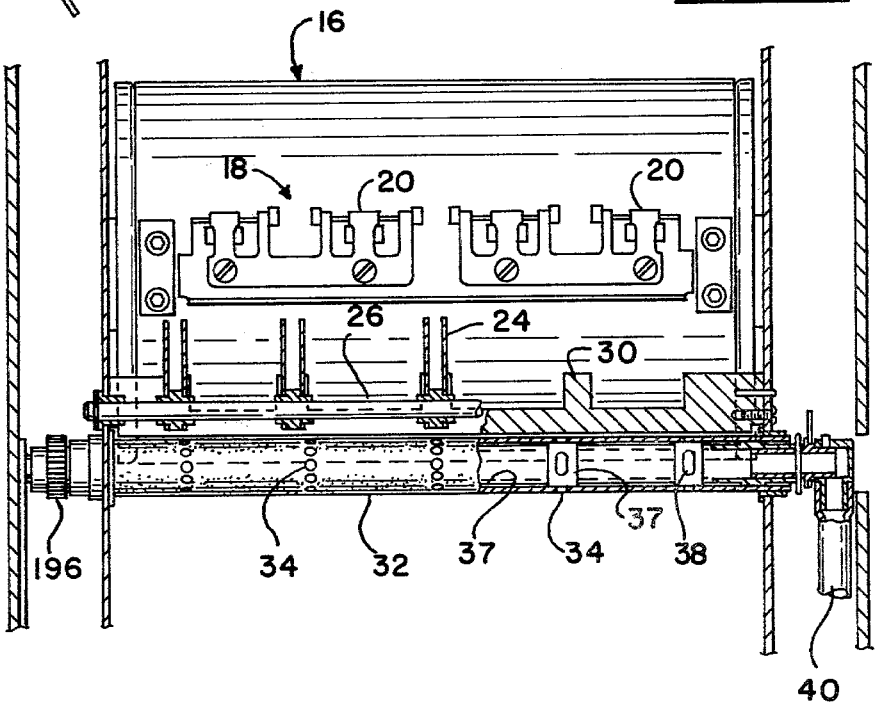
FIG. 3 is a fragmentary view illustrating the sheet guide and stripper means employed in the construction.

The reversing or staging area includes a fixed stripper bar 30 whereby all copy sheets passing beyond the pivotable strippers 24 will be fed to rotary vacuum cylinder 32. As shown in FIGS. 2 and 3, the cylinder 32 defines openings 34 in its periphery, and this cylinder is rotatable about an internal hollow stationary cylinder 36. The cylinder 36 supports spaced-apart bands 37 which each define an opening 38 positioned in line with openings 34. The interior of this cylinder communicates with pipe 40 connected to a pump (not shown) whereby air can be continuously evacuated from within the cylinder 36. This in turn creates suction on the periphery of the rotary cylinder 32 thereby urging copy sheets into contact with this rotary cylinder. This avoids any tendency of the copy sheets to be misdirected after separation from the impression cylinder by means of stripper bar 30.

The openings 38 limit the suction exerted to about a 70° portion of the cylinder 32 so that there is no tendency for the sheets to be held by the cylinder and thus completely wrapped around the cylinder. The cylinder 32 is preferably roughened as by vapor blasting or rubber coated for better traction.

Figure 4:
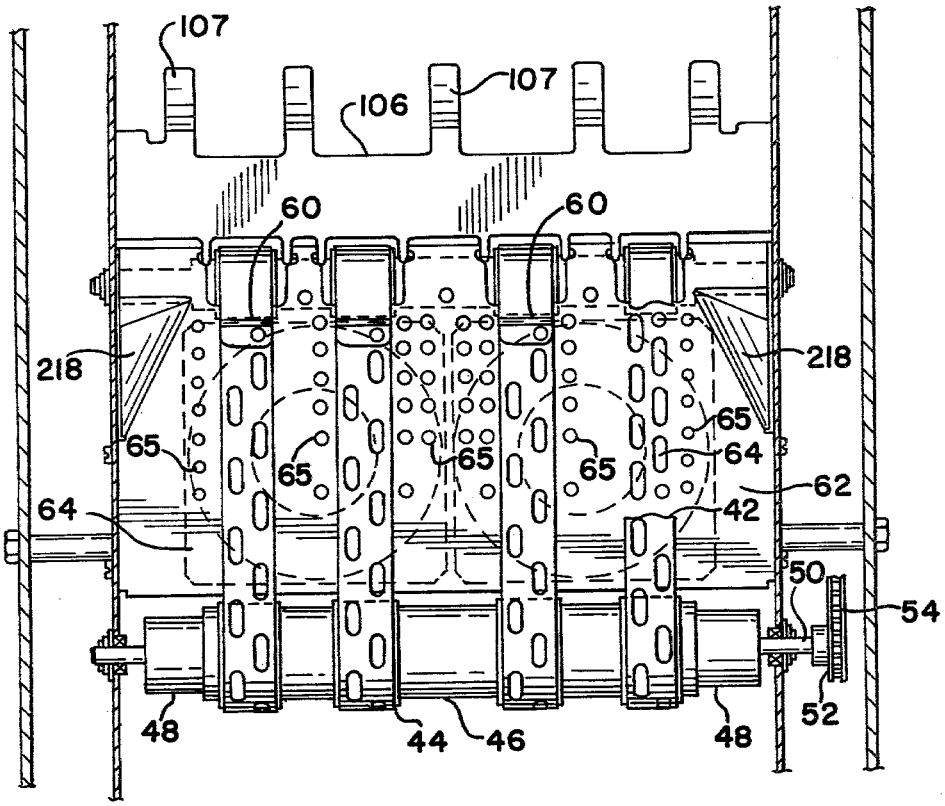
FIG. 4 is a plan view of the conveyor means in the staging area.
Figure 8:
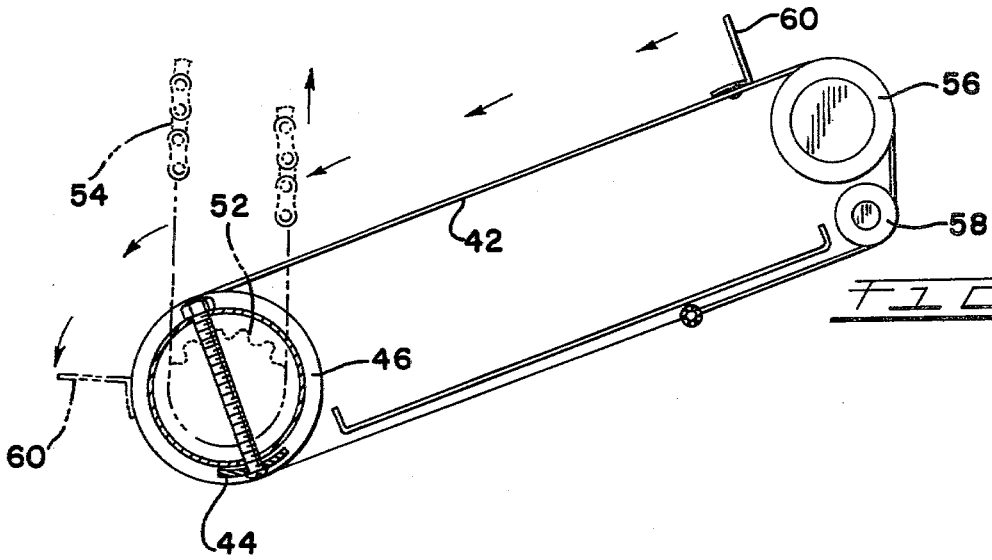
FIG. 8 is a side elevation, partly in section, illustrating the belt drive means in the staging area.

Any suitable guide plate or fingers may be employed to engage the sheets as they move from the cylinder 32. The copy sheets are thereby directed to the bed of a reversing conveyor utilized in the system. As best shown in FIGS. 2, 4 and 8, this conveyor consists of a plurality of parallel belts 42. These belts extend around idler spools 56 and 58 and then around a raised section 44 formed on the cylindrical tube 46 where the ends of each belt are anchored. This tube is pressed into engagement with knurled fitting 48 which also is part of shaft 50 (FIG. 4). A sprocket 52 attached to shaft 50 is driven by means of chain 54 whereby movement is transmitted to the belts. The belts are preferably tied to the tube 46 for positive control of the belt movement.

Preferably, at least two of the belts are provided with a stop member 60, these members being provided for controlling the attitude of copy sheets introduced into the staging area. As indicated, the belts are preferably attached to the sections 44 of the cylindrical tube 46 and the attaching mechanism is preferably such that the belts can be adjustably positioned to permit precise alignment of the stop members 60 and the maintaining of this alignment during operation of the construction.

The belts 42 pass over the top wall of an evacuation chamber. This wall defines a plurality of openings 64 whereby exhaust fans associated with the chamber will create suction to hold each copy sheet in engagement with the belts. As indicated, all belts are preferably perforated to achieve this engagement. The presence of openings 65 in the wall 62 between the belts and the openings 64 beneath the perforated belts serves to hold the copy sheets in engagement with the belts. A larger number of openings 65 are centrally located, and the outermost rows have smaller openings. This concentrates the holding force near the center of the sheets.

As illustrated, the belts are free of openings immediately forward of the stop members 60. Similarly, the wall 62 is imperforate beyond the forward end of the belt travel so that sheets moved into engagement with the stop members are not unduly influenced by suction. This gives the sheets an opportunity to be aligned by the stop members before the suction forces grip the sheets with the sheets being thereafter held firmly in position.

Figure 6:
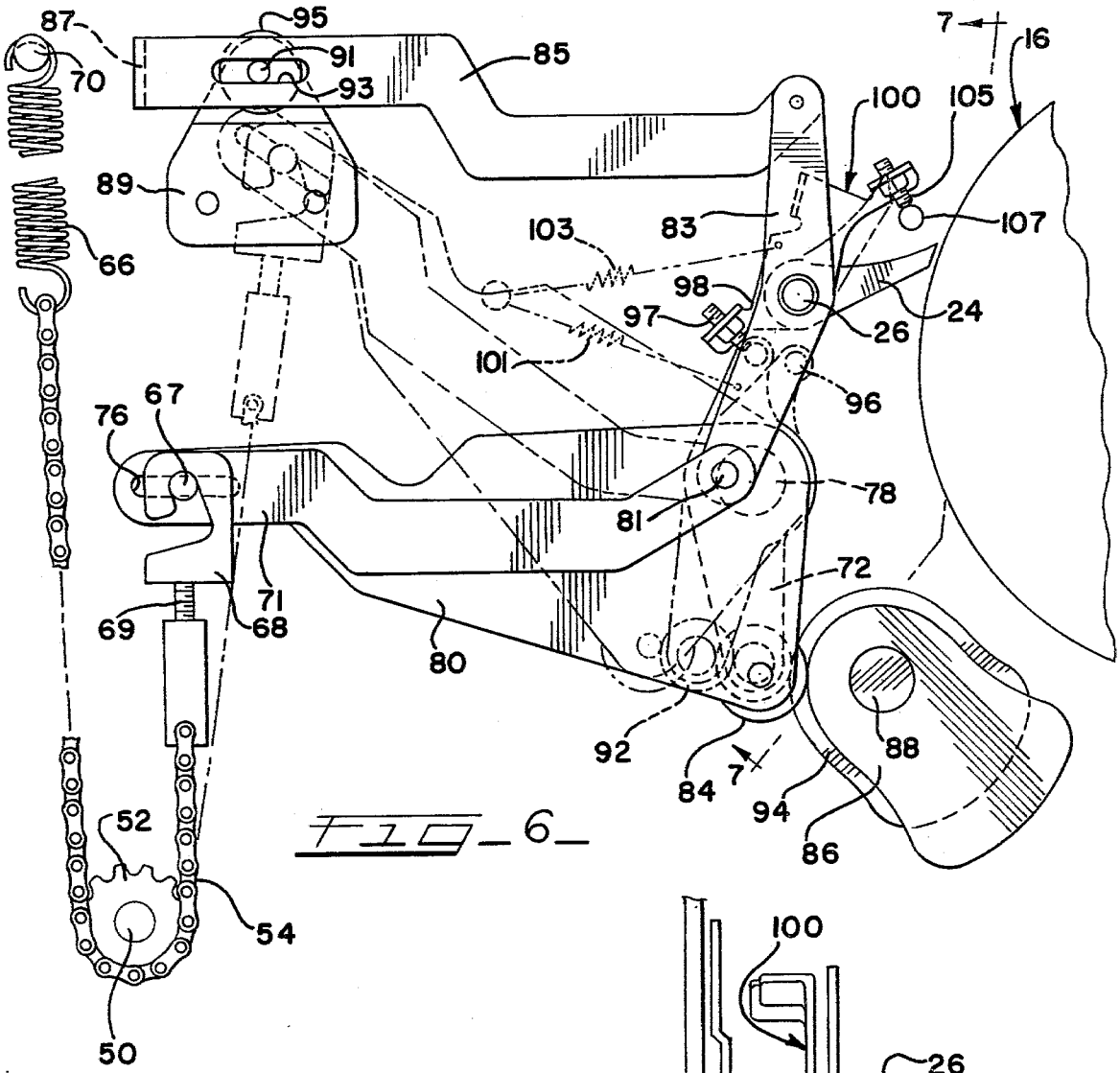
FIG. 6 is a fragmentary view illustrating the stripper control means and staging area conveyor drive means for the construction.

FIG. 6 illustrates the drive socket 52 for the chain 54. One end of this chain is attached to tension spring 66, this spring being secured to the machine housing by means of pin 70. The other end of the chain is attached by means of hook 68 to a pin 67. This pin is attached to arm 71 and extends beyond this arm into a slot 76 defined by lever 80. The arm 71 is pivotally connected to link 83 which in turn is pivotally mounted on shaft 26. By means of a mechanism to be described, the link 83 is adapted to be pivoted for adjusting the position of arm 71 to thereby shift the position of pin 67 relative to the slot 76 of lever 80. This provides a means for adjusting the extent of movement of the chain 54 which in turn affects the movement of belts 42. The threaded shaft 69 of hook 68 provides a means for adjusting tension of the spring 66.

Figure 7:
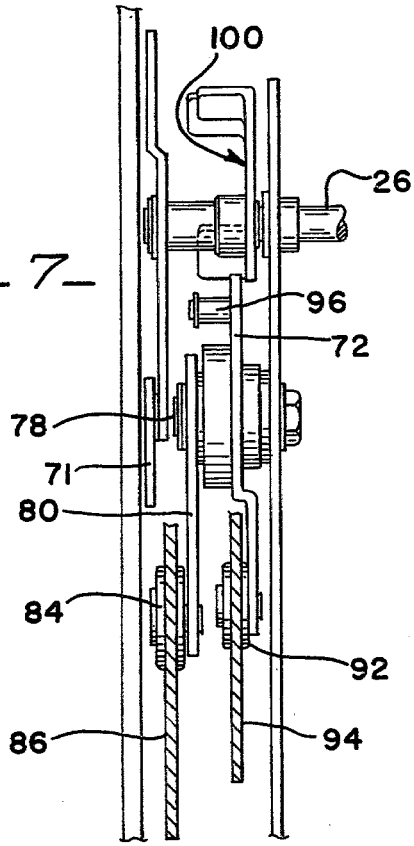
FIG. 7 is an enlarged fragmentary cross-sectional view taken about the line 7—7 of FIG. 6.

The lever 80 is tied to shaft 78. As best shown in FIG. 7, another lever 72 also extends around the shaft 78; however, this lever is movable relative to the shaft.

The lever 80 supports a cam follower 84 which engages cam 86 mounted on cam shaft 88. Counter-clockwise rotation of the shaft 88 will result in pivoting movement of the lever 80 between the solid and dotted line positions shown. It will also be apparent that this movement will result in rotation of sprocket 52 and, therefore, movement of the belts 42.

As indicated, the positioning of the pin 67 serves as a means for fine adjustment of the positions of the stop members 60 on the belts 42 since these positions are controlled by the extent of chain movement. The pin 67 is adjustable by means of movement of link 83 which is attached at its upper end to arm 85. This arm carries a handle 87 which is accessible from the exterior of the machine housing. A bracket 89 mounted to a housing wall supports a threaded pin 91 which extends through slot 93 defined by the arm 85. Locking nut 95 serves to secure the arm in position when the desired location of pin 67 is achieved.

In operation, the levers 71 and 81 always move through a fixed number of degrees regardless of the position of pin 67. Furthermore, the levers always assume the position of FIG. 6 when the belts are in the forward position so that the stop members 60 have a constant forward position irrespective of the adjustment of pin 67. Therefore, when the pin 67 is adjusted to accommodate sheets of different length, the adjustment results in different rearward positions of the stop members 60, but the trailing edges of the sheets on the belts 42 will have a constant predictable position. Accordingly, the relationship of these trailing edges with the second gripper is predictable so that the timing of movement of these trailing edges into the second gripper is readily controllable even where different sheet sizes are involved.

The lever 72 has a cam follower 92 secured thereto and the cam follower engages cam 94 mounted on the shaft 88. The opposite end of the lever 72 supports a pin 96 which engages the threaded pin 97 on arm 98 of a driver 100 attached to shaft 26. The shaft 26 supports the movable stripper fingers 24 and, accordingly, the rotation of cam 94 serves to move these stripper fingers back and forth between operative and inoperative positions.

A pair of springs 101 and 103 each have one end attached to the housing of the machine with the other ends attached, respectively, to the lever 72 and driver 100. The spring 101 holds the cam follower 92 against cam 94 and the spring 103 urges pin 97 toward pin 96. As best shown in FIG. 6, the driver 100 carries an additional threaded pin 105, and this pin is adapted to engage a rod 109 attached to the housing. This combination provides a means for precisely controlling the location of the fingers 24 when in the stripping position.

By controlling the movement of belts 42 and the operation of fingers 24 from cams mounted on the same shaft, these operations can be conveniently synchronized. Specifically, the solid line position of FIG. 6 comprises the condition whereat a copy sheet will be directed to the receiver tray by the stripper fingers 24. With the construction in the duplexing mode of operation, this copy sheet will have an image on both sides.

The belts 42, at this same stage of the operation, will be in the position of FIG. 8, that is, the stop members 60 are in an advanced position. As the cam shaft 88 rotates, the belts 42 will begin retracting movement in response to the cam 86 while the cam 94 will start movement of fingers 24 out of stripping position. Accordingly, the next copy sheet will be directed to the belts 42 while the stop members 60 are moving rearwardly. In the preferred form of operation, a copy sheet will engage spaced-apart stop members 60 and, if the sheet is misaligned, the stop members will serve to square the sheet on the conveyor bed. As already indicated, the suction feature will serve to hold the copy sheets on the belts so that movement of the copy sheets is controlled, but the suction is not of sufficient force to prevent necessary aligning action.

The sheet movement continues rearwardly with the stop members 60 moving below the bed surface 62 and the leading edge of sheet traveling tangentially beyond raised surface 44 of roller 46.

As the cam shaft rotation continues, the "high" of the cam is reached and it will be noted that a cam dwell surface is presented. This results in a momentary pause of the copy sheets on the conveyor. Upon continued cam movement, the belt movement is reversed and the copy sheets are directed back toward the end of the staging area. At the same time, the stripping fingers 24 are pivoted back to a stripping position so that the next copy sheet on the impression cylinder will be directed to the receiver tray.

Copy sheets subjected to the reversing movement are driven into a chute defined by blades 104 and 106, the latter defining curved fingers 107 extending adjacent the impression cylinder surface (FIG. 2). The gripper 18 shown in FIG. 2 is positioned at the exit end of the chute in the full open condition of the gripper whereby a copy sheet 220 is adapted to be received in the crotch defined by the blade 20 and adjacent gripper structure.

The dotted line illustration of the sheet 220 indicates the condition of the sheet prior to the solid line position. It will be noted that a bowed condition characterizes the sheet, and that thereafter the bottom edge of the blade 104 tends to bend the sheet inwardly toward the blade 106.

The timing and speed of the movement of belts 42 is preferably such that the copy sheets exiting from the belts are traveling faster than the peripheral speed of the cylinders with the forward edges of the sheets arriving at the exit end of the chute just after the grippers 18. The greater speed of the copy sheets causes them to "catch-up" with the grippers and also results in positive registry of the sheets in the gripper crotch.

The gripper design is such that the pivoting movement of the grippers relative to the cylinders results in reduction of the peripheral speed of the gripper crotcch relative to the peripheral speed of the cylinder. Thus, as the grippers move from a full open to a clamping position, the crotch of each gripper tends to "back up" relative to the cylinder periphery further insuring a positive grip of the copy sheets.

As described in the aforementioned application, means are provided in these constructions for detecting the presence of paper in association with the grippers. In the absence of paper, the detecting means will generate a signal to initiate movement of the impression cylinder away from the blanket cylinder. In this fashion, the blanket cylinder will avoid contact with the bare surface of the impression cylinder which is highly undesirable in view of the problems encountered when ink is applied directly to an impression cylinder surface.

Figure 9:
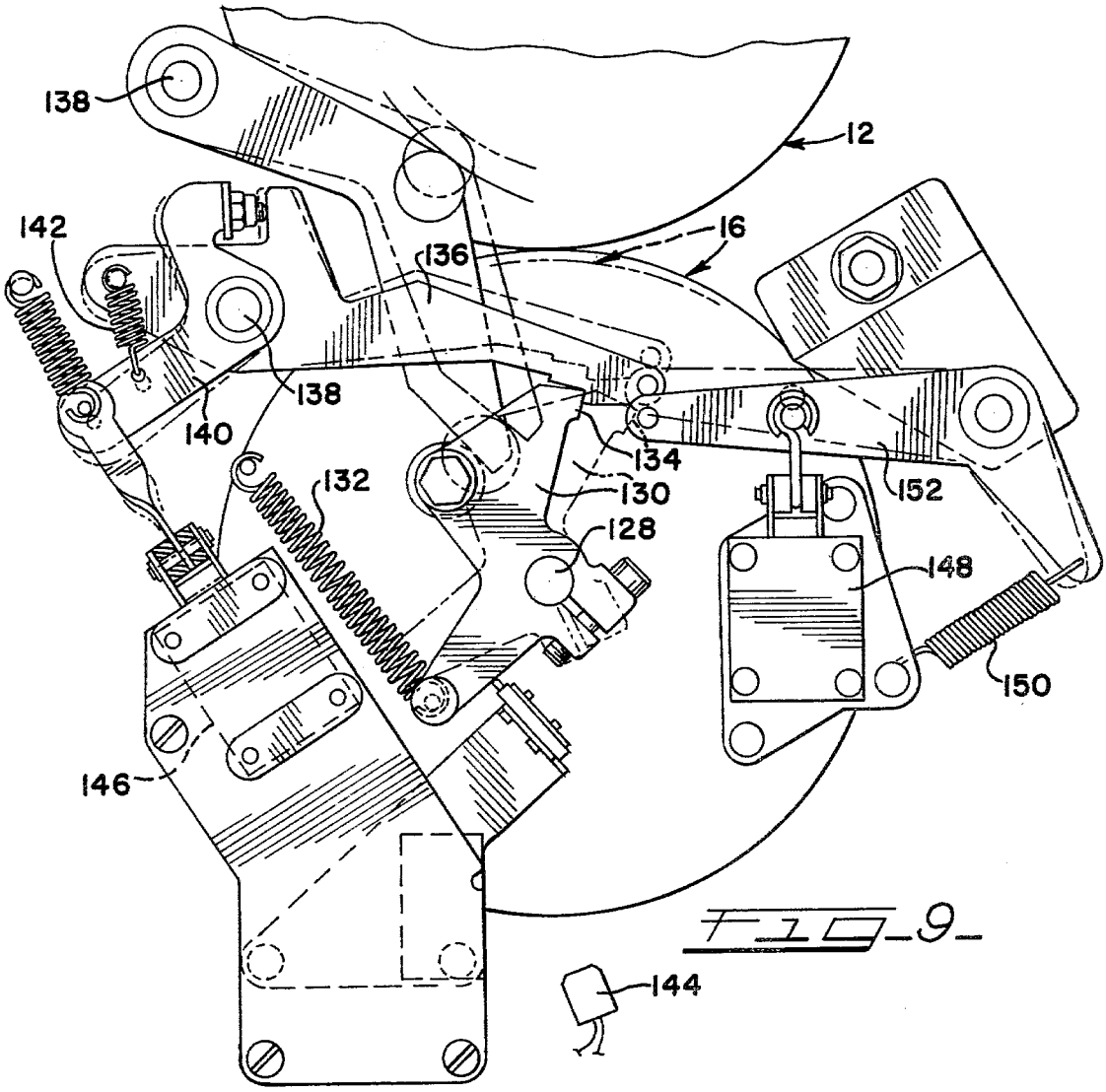
FIG. 9 is an elevational view illustrating the delatch mechanisms employed for cylinder separation.

The mechanisms providing for the retraction of the impression cylinder away from the blanket cylinder are shown in FIG. 9. These structures comprise standard impression cylinder separating mechanisms with supplemental controi means unique to the duplexing system so that the impression cylinder can be moved "off" impression during each half-revolution of operation rather than requiring a full revolution as in a standard operation. More particularly, added paper sensing and cylinder moving mechanisms are provided to insure that a bare impression cylinder surface and the inked blanket surface will come into contact during either half revolution if no paper is fed from the main feed station or from the reversing station.

Referring to FIG. 9, and as more particularly explained in the aforementioned application, the impression cylinder 16 is rotatably supported on a shaft shich includes a stubshaft 128 which is integral with and extends from one end of the supporting shaft. Crank lever 130 is supported by the stubshaft, and when the crank lever is rotated clockwise, the supporting shaft and the peripheral surface of the impression cylinder are moved away from the blanket cylinder located above the impression cylinder.

The crank lever 130 is spring biased in clockwise direction by a spring 132 so that there is a turning force applied to the eccentric stubshaft 128 continually acting to separate the impression cylinder from the blanket cylinder to move the impression cylinder "off" impression. However, movement of the crank lever 130 is normally blocked by a dog 134 locked in a cutout of lever 136. The cutout is fabricated with an acute angle (by one or two degrees) so the dog 134 engages with a locking action and the lever 136 cannot release until the dog 134 is retracted. Lever 136 is supported at a pivot point 138 along with bell crank 140 and the lever and crank are coupled by a spring 142.

As described above, the lever 136 has a locking angle engagement with dog 134 in order to prevent the lever 136 from lifting or rotating counterclockwise when the spring 142 applies the aforedescribed urging force. The lever 136 will not lift until the crank arm 130 and dog 134 are backed away.

The crank arm 130 is backed away twice during each cycle of the impression cylinder, this being controlled by a two-lobe cam as described in the aforementioned application. Thus, if a spring urging force is acting on the arm 136 because paper is no longer being fed into the machine, crank arm 130 and dog 134 being backed away, the lever 136 will swing up and permit crank arm 130 to rotate in a clockwise direction to the dotted line position shown. This applies a turning force to the stubshaft 128 resulting in downward movement of the impression cylinder away from the blanket cylinder.

The application of force to the split lever 136, 140 may be controlled by sensing means such as a photocell 144 employed to monitor the actual presence of paper on the impression cylinder after it has been fed from the reversing station onto the cylinder. The photocell has a predetermined, cyclic operation period, and if the photocell senses the absence of paper on the impression cylinder during its operative time period, it will activate appropriate electrical circuitry to energize solenoid 146. Energization of the solenoid applies a counterclockwise rotation to bell crank 140 stretching spring 142 and, as has been described above, applying an urging force to the lever 136 so it will lift when released by the retraction of crank arm dog 134. Crank arm 130 can then rotate in a clockwise direction and move the impression cylinder "off" impression.

Another solenoid 148 is conventionally used to cause cylinder separation when the power is off. Thus, the solenoid is de-energized when power is off and spring 150 then pivots crank arm 152 to lift lever 136 in response to retraction of crank-lever 130. If, for example, manual rotation of the impression cylinders were to occur, the cam action would insure the cylinder separation.

The construction of the invention is also suitable for use in the production of copies imaged on one side only. In such an arrangement, the pivoting stripper fingers 24 are held in one position only whereby each sheet 14 delivered to a gripper is passed directly to a receiving tray without passing to the staging or re-feeding construction 28. In this connection, it will be understood that, if desired, a second standard feeding mechanism could be substituted for the staging area 28 so that sheets could be delivered to both grippers simultaneously. These sheets would then each take one pass between the blanket and impression cylinders with the separate image areas on the blanket cylinder each applying an image to every other sheet.

Figure 10:
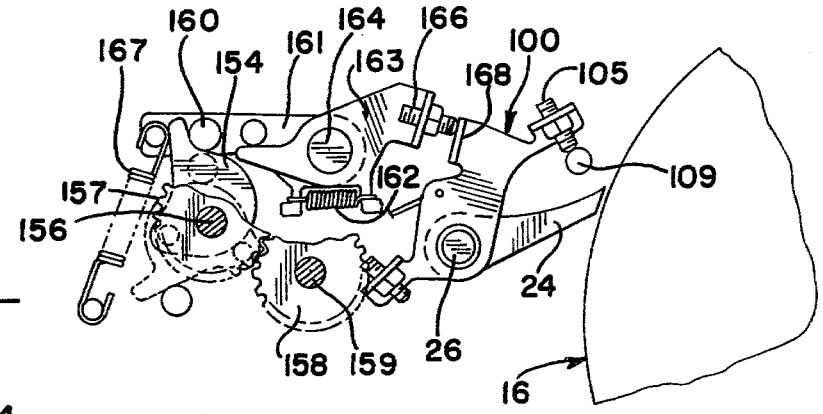
FIG. 10 is a fragmentary view, partly cut away, illustrating the control means for the stripper utilized on the construction.

The construction for controlling the operation of the stripper fingers 24 is illustrated in FIGS. 1, 2 and 10. This construction includes a cam 154 connected to shaft 156 with gear 157 on this shaft being driven by gear 158. A knob (not shown) is provided for manually rotating shaft 159 supporting gear 158 whereby the cam 154 can be moved from the dotted to the solid line position shown in FIG. 10. The cam engages follower 160 mounted on a first lever 161, this lever being attached by means of spring 162 to a second lever 163. Each lever is pivotally supported on shaft 164. Spring 167 holds follower 160 against the surface of cam 154 so that the position of the cam determines the position of the split-lever on shaft 164.

The lever 163 carries a pin 166 interposed in the path of a right angle extension 168 formed on the driver 100, the latter being attached to the shaft 26 supporting the fingers 24. The pin is threaded for adjustment, thus permitting accurate location of the fingers 24 relative to cylinder 16.

When the cam 154 is moved to the solid-line position of FIG. 10, the lever 163 forces driver 100 and fingers 24 to the position shown. As the cam 94 rotates (this cam normally controlling the finger movement), the lever 163 prevents pivoting movement of the driver 100 so that the fingers 24 remain in the stripping position. Accordingly, a "simplex" or single copy mode of operation may be achieved by simply manually rotating shaft 159.

Figure 11:
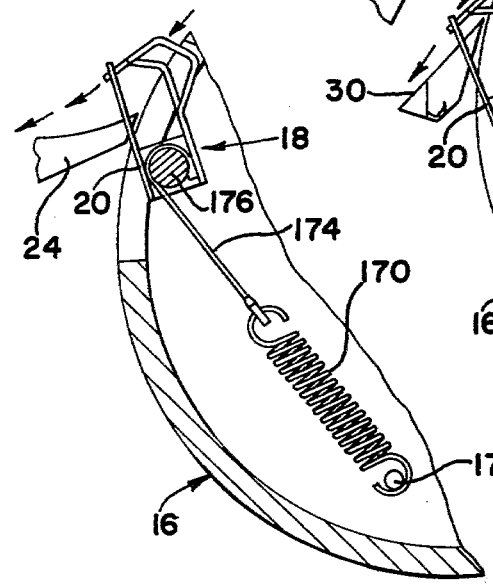
FIG. 11 is a fragmentary view illustrating a gripper design including anti-backlash means.
Figure 12:
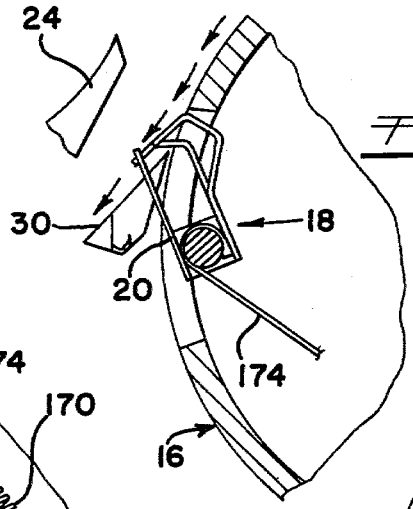
FIG. 12 is a fragmentary view illustrating the gripper at a different operating position.

FIGS. 11 and 12 illustrate an additional feature of the construction. Specifically, the grippers 18 are each provided with an anti-backlash spring 170 having one end mounted at 172 to the interior wall of the impression cylinder. The other end of the spring is connected by means of plastic band 174 to the supporting shaft 176 for the grippers. When the grippers are operated, particularly as described in the aforementioned application, the spring 170 serves to remove all backlash in the gripper actuating mechanism providing more positive and controlled positioning of the grippers in the full open position, especially when receiving the trailing edge of incoming sheet. This position is shown in FIG. 2.

Figure 5:
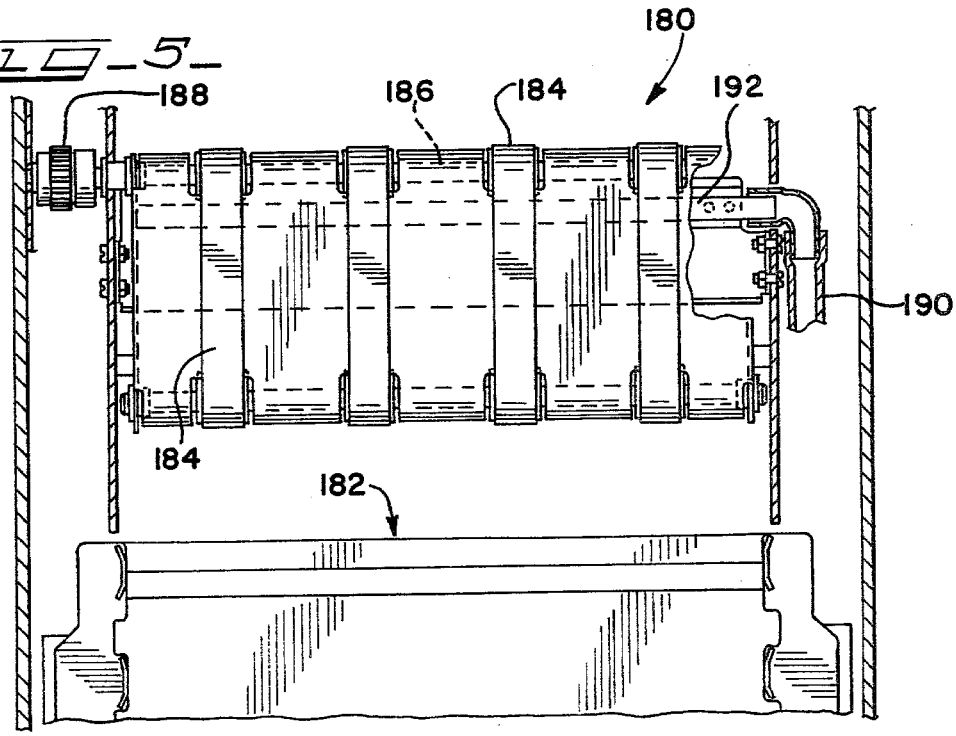
FIG. 5 is a plan view of the conveyor means used for feed to the receiver tray.

FIGS. 1 and 5 illustrate the conveyor means 180 and receiving area 182 for sheets which are directed by stripper fingers 24 away from the impression cylinder. The conveyor means 180 consists of a plurality of belts 184 supported on drive shaft 186, this shaft being driven through gear 188. This conveyor means will be in continuous operation in either the simplex or duplex operating mode of the equipment, and it will operate to impart sufficient force to the sheets so that the sheets will move off the end of the conveyor means into the receiver area 182. An exhaust line 190 may be connected to a perforated pipe 192 positioned beneath the upper flight of belts 184 to insure good contact of the sheets with the belt.

Figure 13:
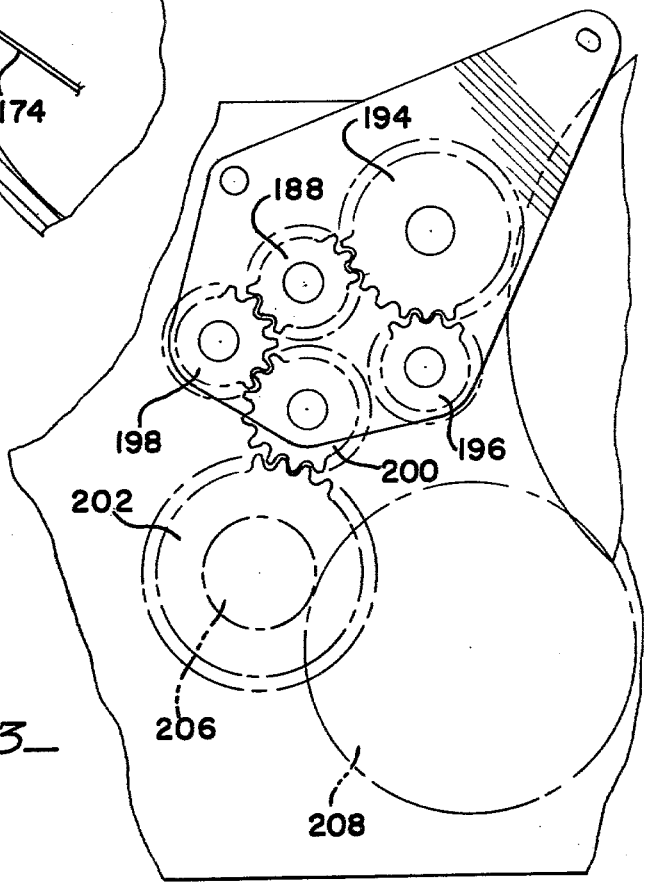
FIG. 13 is a side elevation illustrating the drive gear arrangement for the construction.

FIG. 13 illustrates a drive arrangement for the construction. The arrangement includes a first gear 194 comprising a power takeoff from the impression cylinder. This gear drives the gear 188 which in turn drives the belts 184 utilized for feeding sheets to the receiver tray 182. The gear 196 (FIG. 3) for driving the rotary vacuum cylinder 32 is also directly driven by the gear 194.

Idler gears 198 and 200 are drivingly connected to the gear 188 with the idler gear 200 engaging gear 202. The gear 202 is mounted on a shaft which also supports gear 206 and gear 206 engages gear 208 which is tied to the cam shaft 88.

With the arrangement of FIG. 13, all of the described functions are directly related to the impression cylinder rotation. By providing adjustment capability for the cams, the timing of the various functions can be accurately controlled.

The construction of the invention further includes means for reducing jams in the system which might be caused by bowed or bent edges of copy sheets directed to the staging area. Referring to FIGS. 2 and 4, the forward end of the bed 62 in the staging area defines downturned front edges 218, these edges angling inwardly and eventually blending with the bed surface. If sheets entering the staging area from the roller 32 tend to bow or bend at the edges, the shape of the bed minimizes any tendency of the leading edges of the sheets to catch or hang-up against the forward end of the bed. The taper of the edges 218 then forces the sheets back to a flat condition as the sheets move along the bed. When the sheet movement is reversed, the belts provide the necessary support to maintain the sheets in the substantially flat condition for movement between guides 104 and 106.

Figure 14:
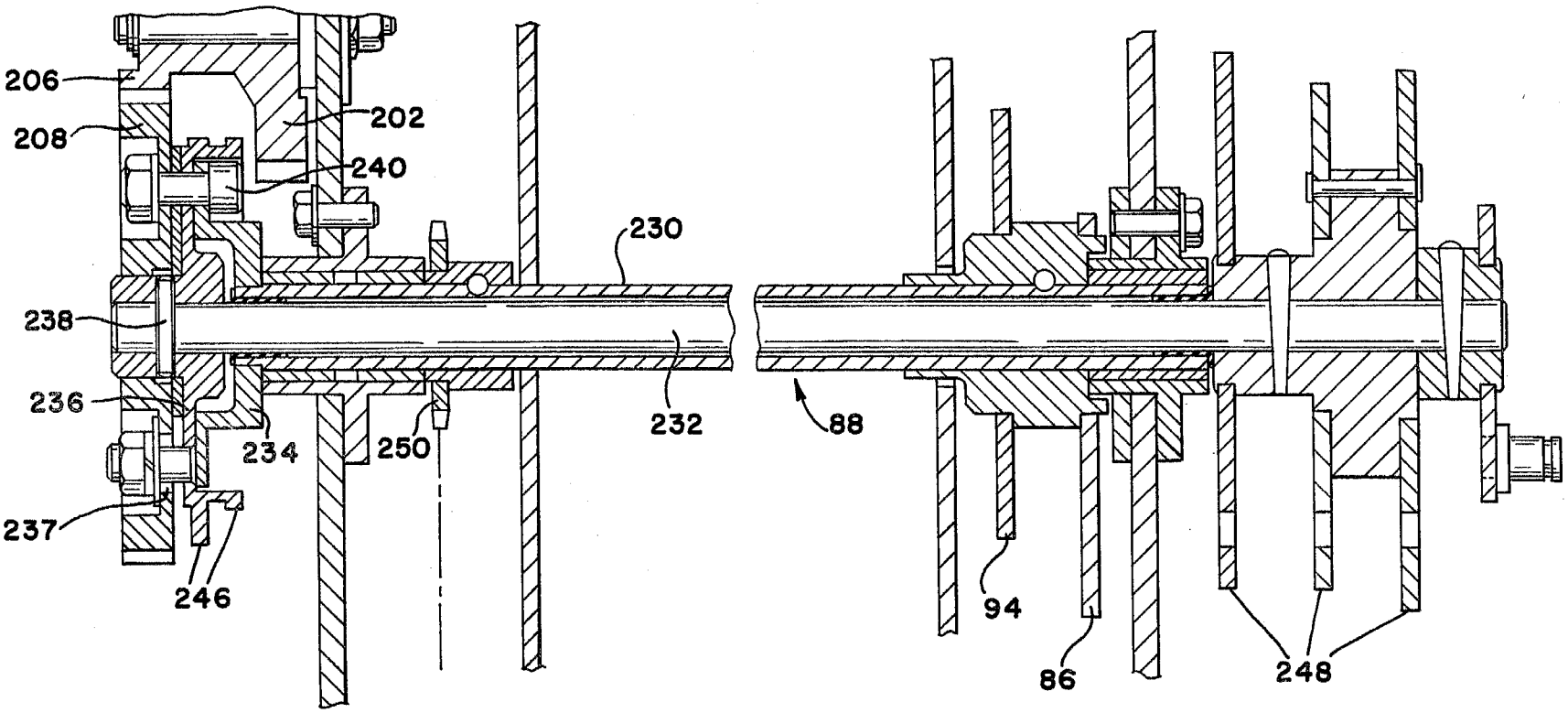
FIG. 14 is a fragmentary cross-sectional view illustrating coaxial cam supporting shafts utilized in the construction.

FIGS. 14 through 16 illustrate preferred means for tying the cam shaft 88 to the drive means. As illustrated, this shaft preferably comprises an outer cylindrical section 230 and an inner shaft 232. The gear 208 is adjustably connected to these shaft sections by means of discs 234 and 236. The disc 234 is fixed to the end of the cylindrical section 230, and a pin 238 provides the means for securing the disc 236 at the inner end of inner shaft 232.

Locking screws 240 include shaft portions extending through disc 234 and into slots 242 defined by the gear 208 and aligned slots defined by disc 236. The shafts are received by adjusting bracket 241 which defines an engaging and reference member 243, this member being received within slot 245. When the nuts for the screws are loosened, movement of bracket 241 operates to adjust the position of disc 234 relative to the gear. The associated cylindrical section 230 is thus adjusted relative to the gear with the indicia on the gear opposite the member 243 indicating the degree of adjustment.

Additional lock screws 244 include shaft portions tied to disc 236. Lock nuts 245 associated with the screws secure this disc relative to the gear 208. These screws are received by enlarged openings 237 of the gear whereby the gear is free for movement relative to the screws and associated discs 236 when the nuts are loosened.

Adjustment of the relative positions of the gear 208 and disc 236 is achieved by means of an eccentric crank pin 254 received by disc 236. The head 256 of the pin is received for rotation within an opening in gear 208, and a slot 258 is defined by the head for receipt of a screw driver or the like. When the screws 244 are loosened, rotation of head 256 operates to adjust the relative positions of the shaft 232 and gear 208. Indicia on the head 256 and gear 208 provides a means for measuring this adjustment.

It will be noted that screws 244 must also be loosened to adjust disc 234 and cylindrical section 230; however, pin 254 maintains the relationship of gear 208 and disc 236 as long as head 256 is not rotated.

The cams 86 and 94 are fixed to the cylindrical section 230. Other cam surfaces for controlling various machine operations may be formed on disc 236 as shown at 246 or may be attached at the end of shaft section 232 as shown at 248. A sprocket 250 is tied to cylindrical section 230, and a chain driven thereby may extend to another cam shaft or the like for achieving still further machine functions. Typically, one cam 246 on shaft 230 will control the secondary feed operation, and the cams 248 on shaft 232 will control the primary feed operation, the latter being shown at the righthand side of FIG. 1, this operation involving the use of suction feet 261. Such operations are utilized in the aforementioned A. B. Dick duplicator models.

The coaxial cam shaft arrangement is of particular value in a duplexing system of the type described since it permits convenient relative adjustments of primary and secondary feeding operations. Thus, the cams located on inner shaft 232 may be confined to controlling primary operations such as feeding of paper sheets to the first gripper for formation of the first image on each sheet. On the other hand, the location of cams 86 and 94 on the cylindrical section 230 provides control of the secondary feed from the staging area and the stripper fingers independently of the primary operations. When it is necessary to adjust the secondary feeding operations, this is accomplished without disrupting the relationship of the primary cam operation to the drive mechanisms.

It will be understood that various changes and modifications may be made in the construction described which provide the characteristics described without departing from the spirit thereof, particularly as described in the following claims.

That which is claimed is:

1. In an offset duplicator including a surface for receiving images transferrable to copy sheets, a carrier, drive means for moving the surface and carrier in unison, means for feeding the copy sheets between the surface and carrier, first and second grippers associated with the carrier for gripping edges of said sheets and for holding the sheets on the carrier, said feeding means feeding each sheet to the first gripper whereby the leading edge of each sheet is engaged by the first gripper for movement between the surface and carrier and for transfer of a first image to one side of each sheet, means for releasing said sheet from said first gripper, and means for re-feeding said sheets, trailing edge first, to said second gripper for movement again between said surface and carrier, and for transfer of a second image to the opposite side of each sheet, the improvement in said re-feeding means comprising a conveyor bed, conveyor means movable over said bed, and drive means for said conveyor means for directing said sheets along said bed in a direction away from said carrier and for reversing the direction of movement of said sheets back toward said carrier, said drive means for said conveyor means including camming means imparting reciprocating movement to said conveyor means, a shaft for supporting said camming means, a coaxially mounted shaft, additional camming means on said coaxially mounted shaft for controlling said feeding means for feeding each sheet to the first gripper, and means for adjusting said first mentioned shaft and said coaxially mounted shaft relative to each other.

2. A construction in accordance with claim 1 including a first disc attached to said first mentioned shaft and a second disc attached to said coaxially mounted shaft, a drive gear for said shafts and means for tying said discs to said drive gear, said adjusting means including means for changing the relative positions of said discs and said gear.

3. In an offset duplicator including a surface for receiving images transferrable to copy sheets, a carrier, drive means for moving the surface and carrier in unison, means for feeding the copy sheets between the surface and carrier, first and second grippers associated with the carrier for gripping edges of said sheets and for holding the sheets on the carrier, said feeding means feeding each sheet to the first gripper whereby the leading edge of each sheet is engaged by the first gripper for movement between the surface and carrier and for transfer of a first image to one side of each sheet, means for releasing said sheet from said first gripper, conveyor means with associated drive means for conveying the sheets away from the carrier and for re-feeding said sheets, trailing edge first, to said second gripper for movement again between said surface and carrier and for transfer of a second image to the opposite side of each sheet, and means for directing said sheets from said carrier to said conveyor means, the improvement in said conveyor means and drive means wherein said conveyor means comprise a conveyor bed and a plurality of spaced-apart belts movable over the conveyor bed, means operating said drive means to drive the belts in a first direction away from said carrier, means for reversing said drive means for changing the direction of movement of said sheets back toward said carrier, and suction means associated with the conveyor means for holding the sheets on the belts during movement of the belts in the first direction and also during movement of the sheets back toward said carrier, and including stop members connected to said belts, the leading edges of sheets delivered to said belts engaging said stop members, said stop members controlling the positions of said sheets relative to said belts.

4. A construction in accordance with claim 3 wherein said suction means comprise air exhaust means positioned beneath said bed, and openings defined by said bed whereby said sheets are drawn positively against said belts and are caused to firmly engage said belts.

5. A construction in accordance with claim 4 wherein at least some of said belts defined perforations for communication with said openings in said bed.

6. A construction in accordance with claim 3 wherein said stop members comprise upstanding barrier means, each barrier means being attached to one belt, engagement of the leading edges of sheets with said barrier means serving to square the position of the sheets on the conveyor means.

7. In an offset duplicator including a surface for receiving images transferrable to copy sheets, a carrier, drive means for moving the surface and carrier in unison, means for feeding the copy sheets between the surface and carrier, first and second grippers associated with the carrier for gripping edges of said sheets and for holding the sheets on the carrier, said feeding means feeding each sheet to the first gripper whereby the leading edge of each sheet is engaged by the first gripper for movement between the surface and carrier and for transfer of a first image to one side of each sheet, means for releasing said sheet from said first gripper, conveyor means with associated drive means for conveying the sheets away from the carrier and for re-feeding said sheets, trailing edge first, to said second gripper for movement again between said surface and carrier and for transfer of a second image to the opposite side of each sheet, and means for directing said sheets from said carrier to said conveyor means, the improvement in said conveyor means and drive means wherein said conveyor means comprise a conveyor bed and a plurality of spaced-apart belts movable over the conveyor bed, means operating said drive means to drive the belts in a first direction away from said carrier, means for reversing said drive means for changing the direction of movement of said sheets back toward said carrier, and suction means associated with the conveyor means for holding the sheets on the belts during movement of the belts in the first direction and also during movement of the sheets back toward said carrier, and wherein said means for directing the copy sheets to said conveyor means move said leading edges freely through the air before contact with the conveyor bed whereby the sides of the sheets tend to bend downwardly, and wherein said conveyor bed defines downturned sides to permit unimpeded movement of the copy sheets onto the bed.

8. A construction in accordance with claim 7 wherein said downturned sides are formed at the forward end of said bed, the downturned sides comprising triangular portions extending a short distance along the bed.

9. In an offset duplicator including a surface for receiving images transferrable to copy sheets, a carrier, drive means for moving the surface and carrier in unison, means for feeding the copy sheets between the surface and carrier, first and second grippers associated with the carrier for gripping edges of said sheets and for holding the sheets on the carrier, said feeding means feeding each sheet to the first gripper whereby the leading edge of each sheet is engaged by the first gripper for movement between the surface and carrier and for transfer of a first image to one side of each sheet, means for releasing said sheet from said first gripper, conveyor means with associated drive means for conveying the sheets away from the carrier and for re-feeding said sheets, trailing edge first, to said second gripper for movement again between said surface and carrier and for transfer of a second image to the opposite side of each sheet, and means for directing said sheets from said carrier to said conveyor means, the improvement in said conveyor means and drive means comprising means operating said drive means to drive the conveyor means in a first direction away from said carrier, means for reversing said drive means for changing the direction of movement of said sheets back toward said carrier, and suction means associated with the conveyor means for holding the sheets on the conveyor means during movement of the conveyor means in the first direction and also during movement of the sheets back toward said carrier and wherein said drive means for said conveyor means include a drive chain, a drive sprocket engageable with said chain, a drive shaft supporting said sprocket, said drive shaft being drivingly connected to said conveyor means, and camming means imparting reciprocating movement to said chain for thereby imparting reciprocating movement to said conveyor means.

10. A construction in accordance with claim 8 wherein said camming means for said conveyor means engages a crank lever for pivoting the crank lever around a supporting axis, and means connecting one end of said chain to said crank lever.

11. A construction in accordance with claim 10 including means for adjusting the connection between said chain and said crank lever to thereby adjust the movement of the conveyor means.

12. A construction in accordance with claim 11 including barrier means associated with the conveyor means for engaging sheets directed to the conveyor means for thereby controlling the position of the sheets on the conveyor means, the adjustment of the connection between said chain and crank lever operating to control the position of engagement of said sheets with said barrier means.

13. A construction in accordance with claim 9 wherein the means for connecting the chain to said crank lever comprises a separate lever associated with the crank lever for movement therewith, and adjustment means for moving the separate lever relative to the crank lever to thereby vary the position of the end of the chain relative to the crank lever.

14. A construction in accordance with claim 13 wherein said conveyor means define stop members for engaging the leading edges of sheets delivered to said conveyor means and for controlling the positions of said sheets relative to said belts, said stop means being located in a constant forwardmost position for engagement by said sheets irrespective of the relative position of said separate lever and said crank lever, adjustment of the separate lever relative to the crank lever varying the rearwardmost position of the stop means, the trailing edges of sheets delivered to the conveyor means thereby defining a constant position relative to the second gripper for refeeding of the sheets.

15. In an offset duplicator including a surface for receiving images transferrable to copy sheets, a carrier, drive means for moving the surface and carrier in unison, means for feeding the copy sheets between the surface and carrier, first and second grippers associated with the carrier for gripping edges of said sheets and for holding the sheets on the carrier, said feeding means feeding each sheet to the first gripper whereby the leading edge of each sheet is engaged by the first gripper for movement between the surface and carrier and for transfer of a first image to one side of each sheet, means for releasing said sheet from said first gripper, conveyor means with associated drive means for conveying the sheets away from the carrier and for re-feeding said sheets, trailing edge first, to said second gripper for movement again between said surface and carrier and for transfer of a second image to the opposite side of each sheet, and means for directing said sheets from said carrier to said conveyor means, the improvement in said conveyor means and drive means comprising means operating said drive means to drive the conveyor means in a first direction away from said carrier, and means for reversing said drive means for changing the direction of movement of said sheets back toward said carrier, the means operating said drive means including camming means imparting reciprocating movement to said conveyor means, a shaft for supporting said camming means, a coaxially mounted shaft, additional camming means on said coaxially mounted shaft for controlling said feeding means for feeding each sheet to the first gripper, and means for adjusting said first mentioned shaft and said coaxially mounted shaft relative to each other.

16. A construction in accordance with claim 15 wherein said conveyor means comprises a conveyor bed and a plurality of spaced-apart belts movable over the conveyor bed, said sheets being supported on said belts.

17. A construction in accordance with claim 15 including a first disc attached to said first mentioned shaft and a second disc attached to said coaxially mounted shaft, a drive gear for said shafts and means for tying said discs to said drive gear, said adjusting means including means for changing the relative positions of said discs and said gear.

* * * * *